United States Patent [19]

Yoshihara et al.

[11] Patent Number: 4,932,860

[45] Date of Patent: Jun. 12, 1990

[54] ELECTROPHOTOGRAPHIC PHOTOSENSITIVE MEMBER

[75] Inventors: Toshiyuki Yoshihara, Mitaka; Masaaki Hiro, Ninomiya; Yoichi Kawamorita, Yokohama; Masaru Nakagawa, Yokohama; Fumio Sumino, Yokohama; Noboru Kashimura, Kawasaki; Masafumi Hisamura, Kawasaki; Tomohiro Kimura, Kawasaki, all of Japan

[73] Assignee: Canon Kabushiki Kaisha, Tokyo, Japan

[21] Appl. No.: 254,708

[22] Filed: Oct. 7, 1988

[30] Foreign Application Priority Data

Oct. 9, 1987 [JP] Japan ..... 62-253890

[51] Int. Cl.[5] ..... G03G 5/04

[52] U.S. Cl. ..... 430/83; 430/58

[58] Field of Search ..... 430/59, 76, 83, 58

[56] References Cited

U.S. PATENT DOCUMENTS 4,463,077 7/1984 Matsuura et al. ..... 430/58
4,563,408 1/1986 Lin et al. ..... 430/59

FOREIGN PATENT DOCUMENTS 2301060 7/1973 Fed. Rep. of Germany .
2347708 5/1974 Fed. Rep. of Germany .
2534966 2/1976 Fed. Rep. of Germany .
57-122444 7/1982 Japan .

*Primary Examiner*—John L. Goodrow
*Attorney, Agent, or Firm*—Fitzpatrick, Cella, Harper & Scinto

[57] ABSTRACT

An electrophotographic photosensitive member comprises a photosensitive layer containing an organic photoconductor provided on an electroconductive substrate, wherein said photosensitive layer contains a compound represented by the formula (1) shown below in an amount ranging from 0.1 to 10% by weight based on the total weight of the photosensitive layer added;

Formula:

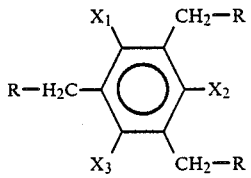

(1)

wherein R represents

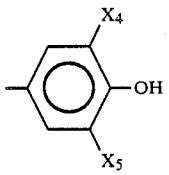

$X_1$, $X_2$ and $X_3$ each represent hydrogen atom or methyl group, $X_4$ represents

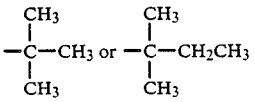

$X_5$ represents hydrogen atom, an alkyl group or an alkenyl group.

10 Claims, No Drawings

ELECTROPHOTOGRAPHIC PHOTOSENSITIVE MEMBER

BACKGROUND OF THE INVENTION

1. Field of the Invention

This invention relates to an electrophotographic photosensitive member, more particularly to an electrophotographic photosensitive member having a photosensitive layer excellent in durability without image quality deterioration by repetition.

2. Related Background Art

In recent years, a large number of electrophotographic photosensitive members having organic compounds as the photoconductor have been developed.

Among them, most of those practically applied have the form of a photoconductor which is functionally separated into a charge generation material and a charge transport material.

An electrophotographic photosensitive member by use of such organic photoconductor is expected to be further improved in electrophotographic characteristics such as sensitivity, light response, etc., due to flexibility of material design, and also it is characterized by easy film forming property and high productivity.

Whereas, an electrophotographic photosensitive member is subject to various image forming processes repeatedly in an electrophotographic device, and during that period, it is required to exhibit stable characteristics. However, the electrophotographic photosensitive member by use of the organic photoconductor as described above has the drawback that lowering in image density accompanied with lowering in charging ability and image quality deterioration such as blurring of the image accompanied with lowering in surface resistance are liable to occur after repeated use.

The cause for these deteriorations may be considered to be the large influence from corona charging.

More specifically, when a photosensitive member is used in a copying machine, it is constantly exposed to an atmosphere of corona discharging, and the organic photoconductor may be considered to be subjected to deterioration by the active species such as ozone formed by corona discharging as copying is performed repeatedly.

Particularly, in an electrophotographic photosensitive member having an organic photoconductor, which is frequently used with negative charging, more amount of ozone is generated than in the case of positive charging, and this is also considered as one factor more susceptible to deterioration as compared with other photosensitive members by use of positive charging.

In the prior art, as the method for preventing such deterioration of electrophotographic photosensitive member, it has been proposed to use various antioxidants such as dilaurylthiodipropionate as disclosed in Japanese Laid-open Patent Publication No. 48-40436, 2,4,6-trialkylphenol derivatives as disclosed in Japanese Laid-open Patent Publication No. 48-75241; hindered amine derivatives as disclosed in Japanese Laid-open Patent Publication No. 50-44835; phenol type compounds, hydroxyanisole type compounds, hydroquinone type compounds, sulfur compounds, organic phosphorus compounds and p-phenylenediamine compounds as disclosed in Japanese Laid-open Patent Publications Nos. 56-130759 and 57-122444; benztriazole derivatives as disclosed in Japanese Laid-open Patent Publication No. 58-120260; hydroxy aromatic compounds as disclosed in U.S. Pat. No. 4,563,408 (corresponding to Japanese Laid-open Patent Publication No. 61-156131); hindered phenol type compounds as disclosed in Japanese Laid-open Patent Publication No. 62-105151; and so on.

By addition of these various antioxidants, deterioration of the photosensitive member can be prevented to some extent. However, practically, further improved prevention effect is required, and at the same time, it would be desirable to have an improved method without causing such problems that these antioxidants themselves act as the trapping agent for migration of the charges to give rise to elevation in light potential ($V_L$).

SUMMARY OF THE INVENTION

The present inventors have investigated methods about the method for improvement by studying the factors of such deterioration of photosensitive members, and consequently found that sufficient deterioration preventive effect can be obtained by addition of a specific antioxidant into a photosensitive layer containing an organic photoconductor. A photosensitive member having no deleterious effects on other electrophotographic characteristics can be obtained, to accomplish the present invention.

An object of the present invention is to provide an electrophotographic photosensitive member having the effect of preventing photosensitive member deterioration and yet without any harm on other electrophotographic characteristics by containing a specific antioxidant.

Another object of the present invention is to provide an electrophotographic photosensitive member having little potential fluctuation and excellent durability after repeated use.

According to the present invention, there is provided an electrophotographic photosensitive member comprising a photosensitive layer containing an organic photoconductor provided on an electroconductive substrate, wherein said photosensitive layer contains a compound represented by the formula (1) shown below in an amount ranging from 0.1 to 10% by weight based on the total weight of the photosensitive layer added;

Formula:

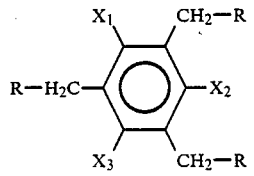

(1)

wherein R represents

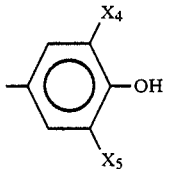

$X_1$, $X_2$ and $X_3$ each represent hydrogen atom or methyl group, $X_4$ represents

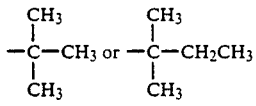

$X_5$ represents hydrogen atom, an alkyl group or an alkenyl group.

More specifically, examples of the alkyl group may include groups having 1 to 10 carbon atoms, and examples of the alkenyl group include those having 2 to 10 carbon atoms as preferable groups.

DETAILED DESCRIPTION OF THE INVENTION

The additive comprising a compound represented by the formula (1) in the present invention is an antioxidant having 3 hindered phenol groups, which has been known as a antioxidant for plastics or rubbers or as the radical trapping agent.

This antioxidant has very high antioxidant function by having 3 hindered phenol groups, and can prevent deterioration of the photosensitive layer by ozone or the active gas formed as accompanied therewith by applying it to an electrophotographic photosensitive member.

Further, the additive will cause no harmful effect to other electrophotographic characteristics within the sufficient range of deterioration prevention effect. This may be considered to be due to the fact that the additive has no other polar group or hetero ring which may cause carrier trapping than hindered phenol groups.

Examples of the compound represented by the formula (1) may include 1,3,5-trimethyl-2,4,6-tris-(3,5-di-t-butyl-4-hydroxy-benzyl)benzene, 1,3,5-trimethyl-2,4,6-tris(3,5-di-(1,1-dimethylallyl)-4-hydroxybenzyl)benzene, 1,3,5-trimethyl-2,4,6-tris-(3,5-di-t-amyl-4-hydroxybenzyl)benzene, 1,3,5-trimethyl-2,4,6-tris(3,5-di-(1,1-dimethyl-2-butenyl)-4-hydroxybenzyl)benzene, 2,4,6-tris (3,5-t-butyl-4-hydroxybenzyl) benzene, 1,3,5-trimethyl-2,4,6-tris(3,5-di-(1-methyl-2-propenyl)-4-hydroxybenzyl)benzene, 1,3-dimethyl-2,4,6-tris-(3,5-di-t-butyl-4-hydroxybenzyl)benzene, 1,3,5-trimethyl-2,4,6-tris(3,5-n-hexyl-4-hydroxybenzyl)benzene, 1,3,5-trimethyl-2,4,6-tris(3-t-butyl-5-t-amyl-4-hydroxybenzyl)benzene, 1,3,5-trimethyl-2,4,6-tris-(3,5-di-isopropyl-4-hydroxybenzyl)benzene, 1,3,5-trimethyl-2-(3,5-di-t-amyl-4-hydroxybenzyl)-4,6-bis(3,5-di-t-butyl-4-hydroxybenzyl)benzene and the like.

The compound having remarkable effect as the antioxidant to be added in the photosensitive layer of the present invention is the compound of the formula (1) wherein $X_5$ is an alkyl group having a tertiary carbon atom having a free valence, particularly t-butyl group or t-amyl group.

The amount of the compound added may be suitably 0.1 to 10% by weight, preferably 0.3 to 5% by weight based on the total weight of the photosensitive layer added.

If the amount added is less than 0.1%, there is no deterioration preventive effect, while if it is over 10%, troubles such as lowering in sensitivity, elevational of residual potential, etc. may be caused.

In the electrophotographic photosensitive member of the present invention, the electrophotographic photosensitive layer containing an organic photoconductor assumes the form of a single layer type photosensitive member in which a charge generating material and a charge transporting material separated in function are mixed together or the form of a laminated photosensitive member comprising a charge generation layer containing a charge generating material and a charge transporting layer containing a charge transporting material laminated on one another.

As the charge generating material, there may be employed organic dyes such as pyrilium, thiopyrilium type dyes, phthalocyanine type pigments, anthanthrone pigments, perylene pigments, dibenzpyrenequinone pigments, pyranthrone pigments, azo pigments, indigo pigments, quinacridone pigments, etc.

As the charge transporting material, there may be employed pyrazoline type compounds, hydrazone type compounds, stilbene type compounds, triphenylamine type compounds, benzidine type compounds, oxazole type compounds, indole type compounds, carbazole type compounds, etc.

In the case of a single layer type photosensitive member, the charge generating material and the charge transporting material as set forth above may be dispersed or dissolved in a suitable binder resin, and a layer is formed by coating on an electroconductive substrate. The film thickness may be 5 μm to 50 μm, preferably 10 μm to 30 μm.

On the other hand, in the case of a laminated type photosensitive member, it may be formed (1) by laminating successively the charge generation layer and the charge transport layer in this order on an electroconductive substrate or (2) by laminating successively the charge transport layer and the charge generation layer in this order.

In the case of (1), as the method for forming the charge generation layer, there may be included the method in which the charge generating material is dispersed or dissolved in a binder resin and a solvent and the coating liquid is coated and the method of vapor deposition or sputtering, etc. The film thickness may be 5 μm or less, preferably 0.01 μm to 3 μm. In this case, an inorganic photoconductor such as selenium, amorphous silicon can be also used.

The charge transport layer may be formed by laminating a coating solution containing the charge transporting material as described above dissolved in a binder resin. The film thickness may be 10 μm to 40 μm, preferably 15 μm to 35 μm.

The additive comprising the compound represented by the formula (1) in the present invention should be preferably contained in the charge transport layer in this case.

On the other hand, in the case of laminating the charge generation layer on the charge transport layer, both layers are formed by coating the charge transporting material and the charge generating material respectively together with a binder resin. In this case, it is preferable to incorporate the charge transporting material also in the charge generation layer.

In this case, the additive comprising the compound represented by the formula (1) should be preferably contained in the charge generation layer or both of the charge generation layer and the charge transport layer.

As the binder resin which can be used in the present invention, there may be included acrylic resin, polycarbonate, polyester, polysulfone, polyallylate, etc.

In the photosensitive layer in the present invention, in order to improve mechanical resistance to friction, damage by sliding of the photosensitive member surface, a lubricant such as fluorine type resin powder or polyolefinic resin powder, etc. may be also contained.

Examples of fluorine type resin powder may include tetrafluoroethylene resin powder, vinylidene fluoride resin powder, trifluorochloroethylene resin powder, copolymers of the monomers constituting these polymers, and examples of polyolefinic resin powder may include polyethylene resin powder, polypropylene resin powder, copolymers of the monomers constituting these polymers, etc.

The amount of the lubricant added may be 1.0 to 30% by weight, preferably 2.0 to 20% by weight based on the total weight of the photosensitive layer added. Also, for improving dispersibility when dispersing the lubricant, various dispersing aids may be also added.

The photosensitive layer in the present invention may further incorporate known additives surface modifiers, plasticizers for improvement of flexibility, etc.

The electroconductive substrate may include known substrates, for example, cylindrical or belt-shaped aluminum, iron, copper or plastic film having a metal vapor deposited thereon. Also, between the substrate and the photosensitive layer, an intermediate layer such as adhesive layer, barrier layer, smooth layer, etc. may be also provided, if necessary.

The electrophotographic photosensitive member of the present invention can be used as the photosensitive member for printers utilizing electrophotography such as laser beam printer, LED printer, LCD printer, CRT printer, etc., in addition to conventional electrophotographic copying machines.

The present invention is described in more detail below by referring to Examples, by which the present invention is not limited at all.

EXAMPLE 1

By use of an aluminum cylinder of 80 mm in diameter and 360 mm in length as the electroconductive substrate, a 5% methanolic solution of a polyamide (trade name: Amilan CM-8000, produced by Toray K.K.) was applied thereon by the dipping method to provide a subbing layer with a thickness of 0.5 μm thereon.

Next, 10 parts of a trisazo pigment (parts by weight, hereinafter the same) of the following formula:

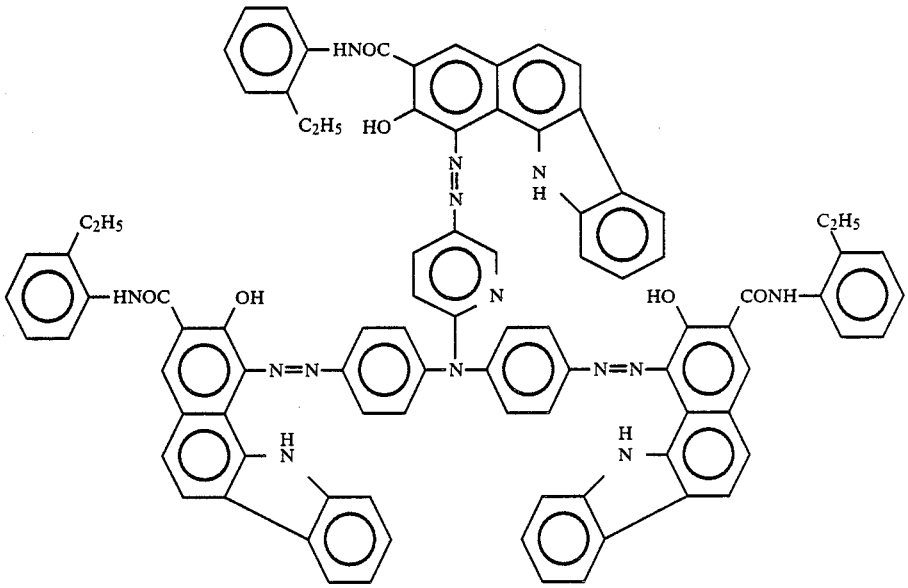

6 parts of a polyvinyl butyral (trade name: S-LEC BL-S, produced by Sekisui Kagaku K.K.) and 50 parts of cyclohexanone were dispersed by a sand mill device by use of glass beads.

Into the dispersion were added 100 parts of methyl ethyl ketone, and the mixture was coated on the subbing layer to form a charge generation layer with a thickness of 0.2 μm.

Next, 10 parts of a stilbene compound of the following formula:

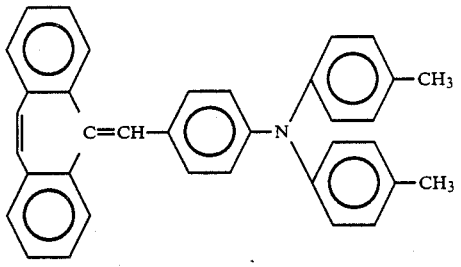

and 10 parts of a polycarbonate (trade name: Panlite L-1250, produced by Teijin Kasei K.K.) were dissolved in 50 parts of dichloromethane and 10 parts of monochlorobenzene to prepare a charge transport layer coating solution.

Into the solution were respectively added 0.04 part, 0.3 part, 0.6 part and 1.8 parts of 1,3,5-trimethyl-2,4,6-tris(3,5-di-t-butyl-4-hydroxybenzyl)benzene (abbreviated as THBZ-1, trade name: IRGANOX 1330, produced by Nippon Ciba-Geigy K.K.), and each mixture was applied on the above charge generation layer to form a charge transport layer with a thickness of 18 μm.

The photosensitive members thus prepared are called Photosensitive member 1, Photosensitive member 2, Photosensitive member 3 and Photosensitive member 4, respectively.

Further, for comparative samples, photosensitive members containing no THBZ-1 and 3 parts of THBZ-1 were prepared, and they are respectively called photosensitive members 5 and 6.

These photosensitive members were mounted on an electrophotographic copying machine (trade name: CLC1, produced by Canon) and the electrophotographic characteristics were evaluated by the following methods.

First, the conditions for latent image were set so that the dark potential ($V_D$) and the light potential ($V_L$) of the photosensitive member were −650 V and −150 V, respectively.

The image exposure dosage at this time was determined to give the initial sensitivity.

Next, the potential after continuous copying of 5,000 sheets was measured to determine the lowering ratio of $V_D$ and the elevating ratio of $V_L$.

Then, the photosensitive member was left to stand in the copying machine and the surface potential after 10 hours was measured. At this time, the portion of the photosensitive member positioned immediately below the corona charger when left to stand was marked and the difference from other portions ($\Delta V_D$) was determined. The results are shown below.

| Photosensitive member | Amount of PHBZ-1 added (%) | Initial sensitivity (lux · sec) | $V_D$ lowering (%) | $V_L$ elevation (V) | $\Delta V_D$ after standing (V) |
|---|---|---|---|---|---|
| 1 | 0.2 | 3.0 | 8.6 | 10 | 25 |
| 2 | 1.5 | 3.0 | 5.5 | 10 | 10 |
| 3 | 3.0 | 3.1 | 4.6 | 20 | 10 |
| 4 | 9.0 | 3.2 | 4.1 | 30 | 10 |
| 5 | 0 | 3.0 | 34.0 | 10 | 80 |
| 6 | 15 | 4.8 | 2.2 | 80 | 5 |

Note:
The amount added is the percentage based on the weight of the photosensitive layer in which THBZ-1 is added (here the charge transport layer).

As is apparent from the above results, for the photosensitive member containing no additive, remarkable lowering in dark potential was observed by receiving electrophotographic processing repeatedly. On the other hand, when the amount added was to much, there occurred the trouble that the light potential was remarkably elevated.

For the photosensitive member containing an adequate amount of the additive, charging ability is lowered little and no trouble in practical application is seen.

EXAMPLE 2

As the charge generation material, 10 parts of a disazo pigment of the following formula:

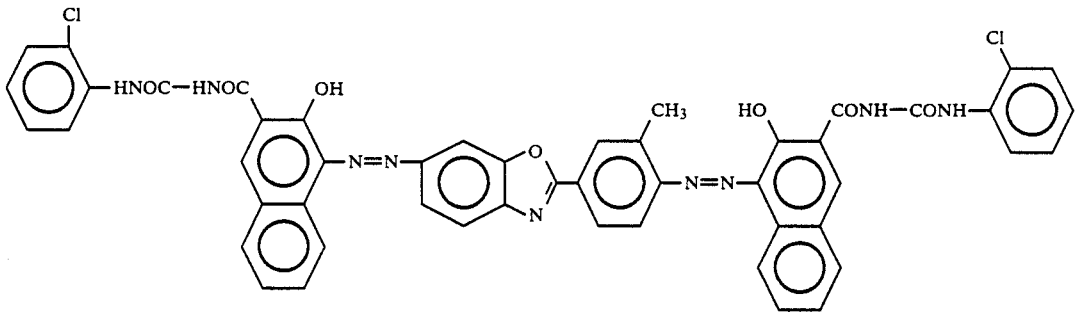

6 parts of the polyvinyl butyral (as used above) and 50 parts of cyclohexanone were dispersed by a sand mill device by use of glass beads. Into the dispersion were added 100 parts of tetrahydrofuran, and the mixture was applied on the substrate and the subbing layer formed similarly as in Example 1 to form a charge generation layer with a thickness of 0.2 μm.

Next, as the charge transporting material, 8 parts of a benzcarbazole compound of the following formula:

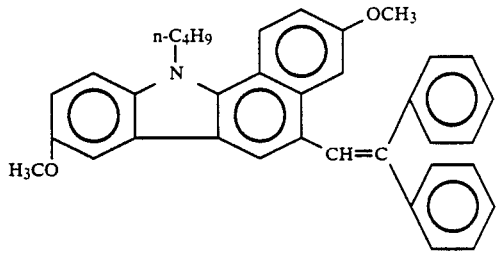

10 parts of a styrene-acrylic copolymer resin (trade name: ESTYLENE MS-200, produced by Shinnippon Seitetsu Kagaku K.K.) and 0.36 part of 1,3,5-trimethyl-2,4,6-tris-(3,5-di-t-amyl-4-hydroxybenzyl)benzene (abbreviated as THBZ-2) were dissolved in 15 parts of dichloromethane and 45 parts of monochlorobenzene, and the resultant solution was applied on the above charge generation layer to form a charge transport layer with a thickness of 18 μm. This is called Photosensitive member 7.

On the other hand, for comparative purpose, a sample containing no THBZ-2 was prepared. This is called Photosensitive member 8.

Further, for comparative samples, photosensitive members containing the 6 kinds of additives shown below were prepared, and they are respectively called Photosensitive members 9, 10, 11, 12, 13 and 14.

Comparative additives:

(added to Photosensitive member 9)
2,2'-butylidene-bis(2-t-butyl-4-methylphenol)
(trade name: Sunilizer BBP, produced by Sumitomo Kagaku Kogyo)

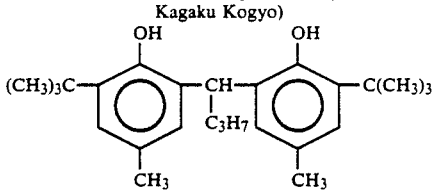

(added to Photosensitive member 10)
triethylene glycol-bis[3-(3-t-butyl-5-methyl-4-hydroxyphenyl)-propionate(trade name: IRGANOX 245, produced by Nippon Ciba-Geigy)

-continued

Comparative additives:

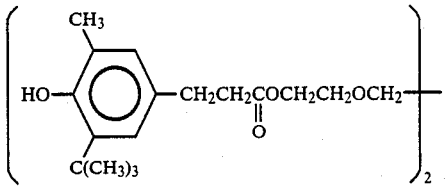

(added to Photosensitive member 11)

2,2'-thiobis(4-methyl-6-butylphenol)(trade name: IRGANOX 1081, produced by Nippon Ciba-Geigy)

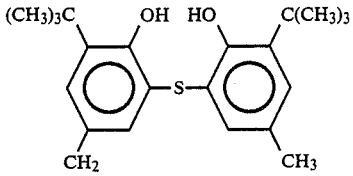

(added to Photosensitive member 12)

bis-(1,2,2,6,6-pentamethyl-4-piperidyl)-2-(3,5-di-t-butyl-4-hydroxybenzyl)-2-n-butylmalonate (trade name: TINUVIN 144, produced by Nippon Ciba-Geigy)

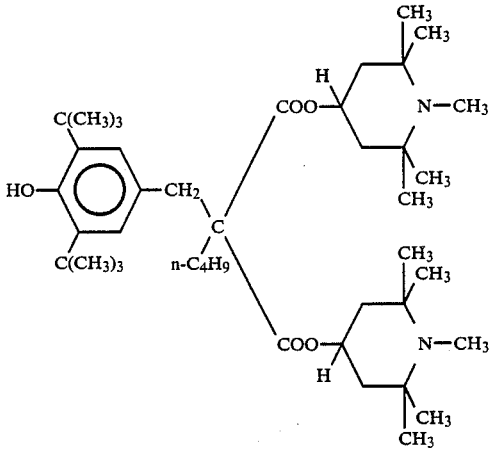

(added to Photosensitive member 13)

2-hydroxy-4-n-octoxybenzophenone (trade name: Sumisorb 130, produced by Sumitomo Kagaku Kogyo)

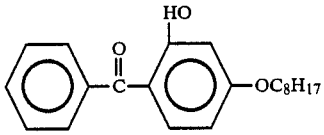

(added to Photosensitive member 14)

2-(2'-hydroxy-3'-t-butyl-5'-methylphenyl)-5-chlorobenzotriazole (Sumisorb 300, produced by Sumitomo Kagaku Kogyo)

-continued

Comparative additives:

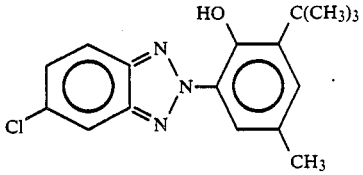

For these photosensitive members, electrophotographic characteristics were evaluated similarly as in Example 1. Also, exposured dosages when initial $V_D$ and $V_L$ were made −650 V and −150 V, respectively, were also measured. The results are shown below.

| Photo-sensitive member | Initial sensitivity (lux · sec) | $V_D$ lowering (%) | $V_L$ elevation (V) | $\Delta V_D$ after standing (V) |
|---|---|---|---|---|
| 7 | 2.8 | 5.1 | 20 | 10 |
| 8 | 2.8 | 28.2 | 20 | 90 |
| 9 | 3.6 | 19.7 | 30 | 70 |
| 10 | 4.1 | 22.3 | 70 | 80 |
| 11 | 3.5 | 29.6 | 30 | 90 |
| 12 | 3.7 | 5.6 | 100 | 20 |
| 13 | 3.0 | 26.6 | 40 | 90 |
| 14 | 3.0 | 27.8 | 30 | 90 |

From the above results, the deterioration preventive effect by the additive in the present invention can be clearly seen, and at the same time it can be also understood that no sufficient effect can be obtained or harmful effects are great with other antioxidants.

EXAMPLE 3

Similarly as in Example 1, a subbing layer was applied on the substrate.

Next, a solution containing 15 parts of a stilbene compound of the following formula:

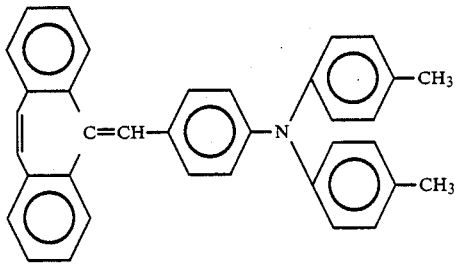

10 parts of the polycarbonate (as used above) dissolved in 50 parts of dichloromethane and 10 parts of monochlorobenzene was applied on the subbing layer to form a charge transport layer with a thickness of 15 μm.

Next, a paint containing 4 parts of a disazo pigment of the following formula:

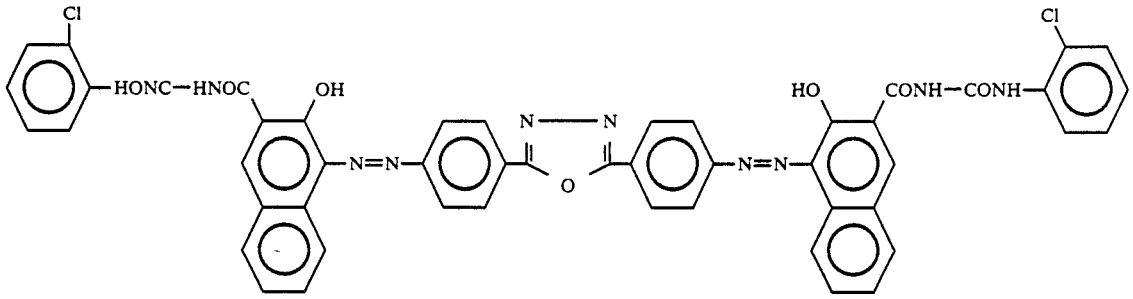

7 parts of the above stilbene compound, 10 parts of the above polycarbonate 0.63 part of THBZ-1 dispersed and dissolved in 150 parts of dichloromethane and 50 parts of monochlorobenzene was spray coated on the above charge transport layer to form a charge generation layer with a thickness of 5 μm. This is called Photosensitive member 15.

On the other hand, a photosensitive member containing no THBZ-1 was prepared, and this is called Photosensitive member 16.

These photosensitive members were positively charged to set $V_D$ to +650 V and $V_L$ to +150 V, and evaluation was conducted similarly described in the foregoing Examples. The results are shown below.

EXAMPLE 4

A subbing layer was coated on the substrate in the same manner as describe in Example 1.

Next, a paint containing 1 part of a disazo pigment of the following formula:

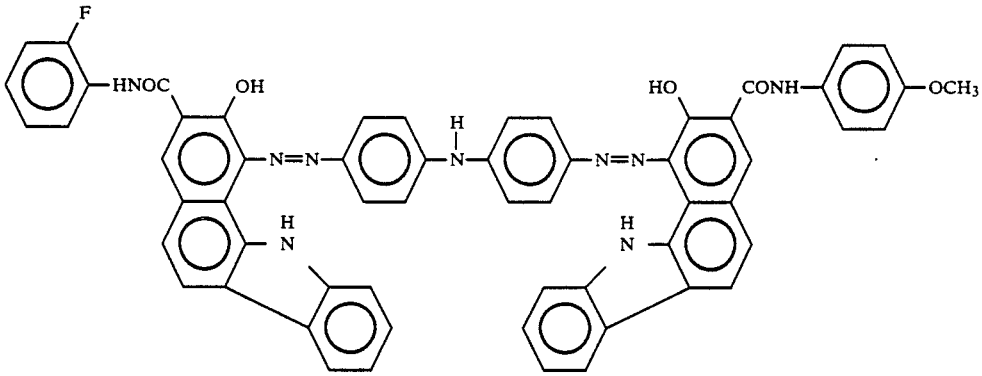

10 parts of a benzcarbazole compound of the following formula:

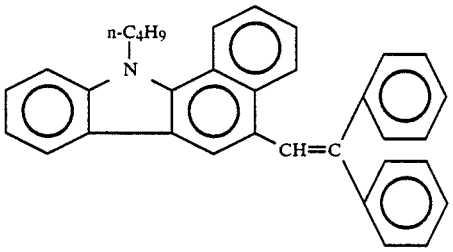

10 parts of the polycarbonate (as used above) and 0.3 part of 2,4,6-tris(3,5-di-t-butyl-4-hydroxybenzyl)benzene (abbreviated as HBZ) dispersed and dissolved in 60 parts of dichloromethane and 20 parts of monochlorobenzene was coated on the above subbing layer to form a photosensitive layer with a thickness of 16 μm, thus preparing a photosensitive member. This is called Photosensitive member 17.

On the other hand, for comparative purpose, a photosensitive member having a photosensitive layer containing no HBZ was prepared. This is called Photosensitive member 18. For these photosensitive members, the same evaluation as in Example 3 was conducted. The results are shown below.

| Photosensitive member | $V_D$ lowering (%) | $V_l$ elevation (V) | $\Delta V_D$ after standing (V) |
|---|---|---|---|
| 15 | 6.1 | 10 | 20 |
| 16 | 35.8 | 10 | 120 |
| 17 | 5.2 | 30 | 20 |
| 18 | 29.1 | 20 | 100 |

EXAMPLE 5

Photosensitive members were prepared in the same manner as in Example 1 except that the following compounds were used as the additive.

Photosensitive member 19: added compound 1,3-dimethyl-2,4,6-tris(3,5-di-t-butyl-4-hydroxybenzyl)-benzene Photosensitive member 20: added compound 1,3,5-trimethyl-2,4,6-tris(3-t-butyl-5-t-amyl-4-hydroxybenzyl)benzene Photosensitive member 21: added compound 1,3,5-trimethyl-2-(3,5-di-t-amyl-4-hydroxybenzyl)-4,6-bis(3,5-di-t-butyl-4-hydroxybenzyl)benzene.

These photosensitive members were evaluated similarly as described in the foregoing Examples. The results are shown below.

| Photo-sensitive member | Initial sensitivity (lux · sec) | $V_D$ lowering (%) | $V_L$ elevation (V) | $\Delta V_D$ after standing (V) |
|---|---|---|---|---|
| 19 | 3.0 | 5.7 | 20 | 10 |
| 20 | 3.0 | 5.4 | 10 | 20 |
| 21 | 3.1 | 5.5 | 10 | 10 |

EXAMPLE 6

For the photosensitive members 2, 5 and 7 prepared n Example 1 and Example 2, 45,000 sheets of copying were further performed after 5,000 sheets of copying in the evaluation of the electrophotographic characteristics as described above.

As the results, for the Photosensitive members 2 and 7 containing the antioxidants added therein, there was no lowering of image quality as compared with the initial stage after sucessive copying of 50,000 sheets, whereby contrast was stably high to give images without irregularity.

On the other hand, the Photosensitive member 5 of Comparative sample in which no antioxidants was added revealed remarkable lowering in image density after successive copying of around 15,000 sheets. Also, due to potential lowering generated during stopping and standing after intermission of copying, images with very much irregularity were obtained.

EXAMPLE 7

Similarly as described for Photosensitive member 7 in Example 2, the procedure of forming by way of coating to the charge generation layer was repeated. Next, for formation of a charge transport layer, the same constituent materials for the charge transporting material used in Photosensitive member 7, namely the binder resin, the solvent, and the additive (THBZ-2), and further 0.9 part of tetrafluoroethylene resin powder (trade name: LUBRON L-2, produced by Daikin Kogyo) and 0.09 part of a fluorine type graft polymer as the dispersing aid were prepared, and these were dispersed by a sand mill to make up a coating liquid.

This was coated on the charge generation layer to form a charge transport layer with a thickness of 18 μm. This is called Photosensitive member 22.

| Photo-sensitive member | Initial sensitivity (lux · sec) | $V_D$ lowering (%) | $V_L$ elevation (V) | $\Delta V_D$ after standing (V) |
|---|---|---|---|---|
| 22 | 2.9 | 5.3 | 30 | 10 |

After this evaluation, 75,000 sheets of copying were further performed, and it was found that there no lowering of image even after successive copying as compared with the initial state to give images without irregularity.

What is claimed is:

1. An electrophotographic photosensitive member comprising a photosensitive layer containing an organic photoconductor provided on an electroconductive substrate, wherein said photosensitive layer contains a compound represented by the formula (1) shown below in an amount ranging from 0.1 to 10% by weight based on the total weight of the photosensitive layer added;

Formula:

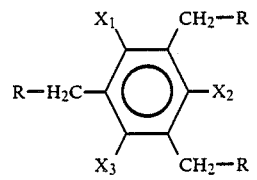

(1)

wherein R represents

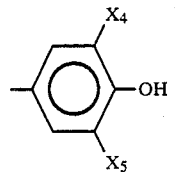

$X_1$, $X_2$ and $X_3$ each represent hydrogen atom or methyl group, $X_4$ represents

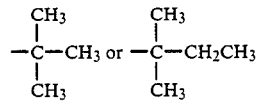

$X_5$ represents hydrogen atom, an alkyl group or an alkenyl group.

2. An electrophotographic photosensitive member according to claim 1, wherein said photosensitive layer has a laminated structure of a charge generation layer and a charge transport layer.

3. An electrophotographic photosensitive member according to claim 1, wherein said photosensitive layer has a structure having a charge transport layer laminated on a charge generation layer, and the compound represented by the formula (1) is contained in the charge transport layer.

4. An electrophotosensitive photosensitive member according to claim 1, wherein said photosensitive layer has a structure having a charge generation layer laminated on a charge transport layer, and the compound represented by the formula (1) is contained in at least the charge generation layer.

5. An electrophotographic photosensitive member according to claim 1, wherein said photosensitive layer has a single layer structure comprising a mixture of a charge generating material and a charge transporting material.

6. An electrophotographic photosensitive member according to claim 1, wherein said photosensitive layer contains a lubricant.

7. An electrophotographic photosensitive member according to claim 1, wherein said photosensitive layer has a structure having a charge transport layer laminated on a charge generation layer, and the charge transport layer contains a compound represented by the formula (1) and a lubricant.

8. An electrophotographic photosensitive member according to claim 6 or claim 7, wherein said lubricant is fluorine type resin powder or a polyolefinic resin powder.

9. An electrophotographic photosensitive member according to claim 1, wherein $X_5$ in the compound represented by the formula (1) is an alkyl group having a tertiary carbon atom having a free valence.

10. An electrophotographic photosensitive member according to claim 1, wherein $X_5$ in the compound represented by the formula (1) is t-butyl group or t-amyl group.

* * * * *

UNITED STATES PATENT AND TRADEMARK OFFICE

CERTIFICATE OF CORRECTION

PATENT NO. : 4,932,860

DATED : June 12, 1990

INVENTOR(S) : TOSHIYUKI YOSHIHARA, ET AL.

It is certified that error appears in the above-identified patent and that said Letters Patent is hereby corrected as shown below:

COLUMN 2

Line 18, "about the method" should be deleted.

COLUMN 3

Line 19, "a" should read --an-- and "the" should read --a--.
Line 62, "elevational" should read --elevation--.

COLUMN 4

Line 40, "selenium, amor-" should read --selenium or amor- --.

COLUMN 5

Line 43, "additives" should read --additives,--.

COLUMN 7

Line 27, "PHBZ-1" should read --THBZ-1--.
Line 42, "to" should read --too--.

COLUMN 9

Line 25, " / " should read -- / --.
$CH_2$ $CH_3$

UNITED STATES PATENT AND TRADEMARK OFFICE

CERTIFICATE OF CORRECTION

PATENT NO. : 4,932,860

DATED : June 12, 1990

INVENTOR(S) : TOSHIYUKI YOSHIHARA, ET AL.

It is certified that error appears in the above-identified patent and that said Letters Patent is hereby corrected as shown below:

COLUMN 10

Line 14, "exposured" should read --the exposure--.
Line 62, "was" should read --were--.

COLUMN 11

Line 5, "HONC—HNOC" should read --HNOC—HNOC--.
Line 15, "polycarbonate" should read --polycarbonate,--.
Line 17, "was" should read --were--.
Line 26, "similarly" should read --similarly as--.
Line 31, "describe" should read --described--.

COLUMN 12

Line 14, "was" should read --were--.

COLUMN 13

Line 12, "n" should read --in--.
Line 24, "antioxidants" should read --antioxidant--.
Line 56, "there" should read --there was--.

UNITED STATES PATENT AND TRADEMARK OFFICE

CERTIFICATE OF CORRECTION

PATENT NO. : 4,932,860

DATED : June 12, 1990

INVENTOR(S) : TOSHIYUKI YOSHIHARA, ET AL.

It is certified that error appears in the above-identified patent and that said Letters Patent is hereby corrected as shown below:

COLUMN 14

Line 38, "electrophotosensitive" should read --electrophotographic--.

Signed and Sealed this

Tenth Day of March, 1992

*Attest:*

HARRY F. MANBECK, JR.

*Attesting Officer*

*Commissioner of Patents and Trademarks*